United States Patent [19]

Delacour et al.

[11] Patent Number: 4,533,526

[45] Date of Patent: Aug. 6, 1985

[54] PROCESS FOR RECOVERING POLYMETAL COMPOUNDS DISCHARGED FROM A SUBMARINE HYDROTHERMAL SOURCE AND DEVICES FOR CARRYING OUT THE SAME

[75] Inventors: Jacques Delacour, Paris; Emile Levallois, Courbevoie; Patrick Antier, Niort; Francois-Xavier Saint Martin, Epinal, all of France

[73] Assignee: Institut Francais du Petrole, Rueil-Malmaison, France

[21] Appl. No.: 451,674

[22] Filed: Dec. 21, 1982

[30] Foreign Application Priority Data

Dec. 21, 1981 [FR] France ..... 81 24049

[51] Int. Cl.[3] ..... C01B 17/20

[52] U.S. Cl. ..... 423/1; 60/641.2; 60/641.5; 166/302; 166/369; 210/696; 210/757; 299/8; 299/9

[58] Field of Search ..... 210/722, 912, 696–698, 210/757; 299/8, 9; 60/641.2, 641.5; 166/302, 369, 370; 423/1

[56] References Cited

U.S. PATENT DOCUMENTS

| | | | |
|---|---|---|---|
| 33,574 | 10/1881 | Cook | 210/722 |
| 1,851,565 | 3/1932 | Claytor | 299/8 |
| 2,132,800 | 10/1938 | Payton | 299/9 |
| 3,658,181 | 4/1972 | Blair | 210/170 |
| 3,745,773 | 7/1973 | Cunningham | 61/46 |
| 3,757,516 | 9/1973 | McCabe | 166/369 |
| 3,782,468 | 1/1974 | Kuwada | 166/369 |
| 3,837,707 | 9/1974 | Kilroy | 299/8 |
| 3,957,108 | 5/1976 | Van Huisen | 166/302 |
| 3,967,393 | 7/1976 | Nixon | 37/58 |
| 4,043,129 | 8/1977 | McCabe et al. | 166/369 |
| 4,052,857 | 10/1977 | Altschuler | 166/302 |
| 4,054,175 | 10/1977 | Swearingen | 60/641.2 |
| 4,127,989 | 12/1978 | Mickelson | 60/641 |
| 4,131,161 | 12/1978 | Lacquement | 166/369 |
| 4,157,847 | 6/1979 | Williams et al. | 299/6 |
| 4,168,971 | 9/1979 | Szczepanski | 75/118 R |
| 4,202,177 | 5/1980 | Garrett | 60/641.2 |
| 4,224,151 | 9/1980 | Jost | 210/696 |
| 4,242,305 | 12/1980 | Spevack | 423/210 |
| 4,244,190 | 1/1981 | Lieffers | 60/641.5 |
| 4,364,232 | 12/1982 | Sheinboum | 60/641.2 |
| 4,378,047 | 3/1983 | Elliot et al. | 166/370 |

FOREIGN PATENT DOCUMENTS

| | | |
|---|---|---|
| WO81/00875 | 4/1981 | PCT Int'l Appl. . |
| WO81/01310 | 5/1981 | PCT Int'l Appl. . |
| 2063776 | 11/1980 | United Kingdom . |
| 2063777 | 11/1980 | United Kingdom . |

OTHER PUBLICATIONS

Schultze et al., "Operation of a Mineral Recovery Unit on Brine from the Salton Sea Known Geothermal Resource Area", U.S. Dept. of Interior Report of Investigations 8680.

Bartlett et al., "Extraction of Non-Ferrous Metals from High Salinity Brine Geothermal Brine by Sulfide Precipitation", Society of Mining Engineers of AIME.

*Primary Examiner*—Howard S. Williams
*Assistant Examiner*—Terryence Chapman
*Attorney, Agent, or Firm*—Millen & White

[57] ABSTRACT

A process and device for recovering polymetal compounds discharge from a submarine hydrothermal source comprises the use of a device comprising a bell-shaped collector member provided with a flexible skirt and placed just above the hydrothermal source to cover it substantially tightly. Means are connected to said collector for withdrawing hydrothermal fluid from the source and means are provided for concentrating the polymetal compounds thereof by settling or by centrifugation with a pipe for raising the so-concentrated flow to a surface installation associated with a bottom turbine energized by power derived from the hydrothermal fluid energy.

10 Claims, 6 Drawing Figures

PROCESS FOR RECOVERING POLYMETAL COMPOUNDS DISCHARGED FROM A SUBMARINE HYDROTHERMAL SOURCE AND DEVICES FOR CARRYING OUT THE SAME

BACKGROUND OF THE INVENTION

The present invention relates to a process for recovering polymetal compounds discharged from a submarine hydrothermal source and to devices for carrying out this process.

From 1977 to 1979, hot sources and accumulations of the above-mentioned substances around these sources have been observed in several occurrences during surveys from submersibles at various points of the Pacific ridge and by floors of about 2800 meters.

The temperature of the water issued from these sources varies between 10° and 350° C. and the deposited products comprise, depending on the temperature, iron or manganese oxides, calcium and barium sulfates, silica and sulfides of such metals as Fe, Zn, Cu, Pb, Ag.

According to the geophysicists, these sources correspond to a circulation of the sea water through the network of fractures of the oceanic ridges. Sea water, when penetrating into rock masses would warm up and dissolve a certain number of elements which have been more or less well integrated during the cooling down of the basaltic magma.

By convection the hot waters would rise up to the surface at speeds varying in accordance with the fracturation state.

At emergence, the more or less abrupt temperature decrease, resulting from the contact with the sea water, would induce a fractionated precipitation of the dissolved substances. Thus, sources at 300°–350° C. would be capable of raising up sulfides, whereas at about 200° C., the latter would have been probably deposited within the rock and only sulfates would be observed. Waters at 20° C. would carry therewith only infinitesimal amounts of the most soluble materials.

Consequently, only sources at high temperature, of present or of fossil origins, may be of economic interest over a long period and may constitute a non-negligible source of raw materials in spite of their sporadic distribution and of their episodic operation. The latter moreover, would be of about ten years, thus substantially the same as the exploitation period of a metal mine.

SUMMARY OF THE INVENTION

The present invention concerns a process and devices adapted to the recovery of metal polysulfides discharged from high temperature submarine sources.

An important difficulty, overcome by the present invention, results from the rapid dilution of the hydrothermal fluid when issuing from the source.

At a height of 2 meters above the source, the particles concentration of the hydrothermal fluid is already divided by a factor higher than 10.

The invention resolves in particular this problem by the provision of a process for recovering the polymetal compounds discharged from underwater hydrothermal sources, characterized in that hydrothermal fluid issuing from the source is withdrawn in the immediate vicinity of this source, during the periods of activity thereof, and the polymetal compounds are concentrated in the so-withdrawn fluid in order to raise to the surface a fluid of higher polymetal compounds content.

The increase of the polymetal compounds content of the withdrawn fluid may be enhanced by adding thereto agents for precipitating these compounds.

According to a characteristic of the process of the invention, power is generated in the vicinity of the hydrothermal source by actuating at least one turbine by means of an auxiliary fluid which is caused to flow in a closed circuit while taking thermal energy from the hydrothermal fluid, and at least a part of the energy developed by said turbine is used to drive upwardly to the surface the fluid enriched with polymetal compounds.

BRIEF DESCRIPTION OF THE DRAWING

Examples of embodiments of the invention are illustrated by the accompanying drawings wherein.

DETAILED DESCRIPTION OF THE INVENTION

In the figures, reference 1 designates a surface installation advantageously formed of a dynamically positioned supporting installation. Hereinafter, and only by way of example, the considered supporting installation 1 is a ship. Reference 2 designates the pipe for raising up fluid enriched with polymetal compounds.

This riser pipe, or at least its upper part, may be a flexible pipe capable of withstanding longitudinal and crushing strains, such as described for example, in the U.S. Pat. No. 3,858,616. Support-means which may comprise a metal tower or derrick 1*a* are adapted to hold the pipe in water from the ship 1.

At its upper part, the flexible pipe passes over a return pulley provided in the derrick, and from there over handling and storing means (not shown), which may comprise a driving member of the endless chain type provided with clamping pads for the pipe and/or a storage reel. This reel will comprise, in a known-per-se manner, a drum or hub comprising at one of its ends, a hydraulic revolving joint through which the fluid to be raised up through pipe 2 can flow. A compensation system for the heave or vertical movements of the ship 1, resulting from the wave motion, will be interposed between the return pulley and the derrick supporting the latter.

This system (not shown) will, for example, be of the type described in the U.S. Pat. No. 3,285,574.

Figure 1:
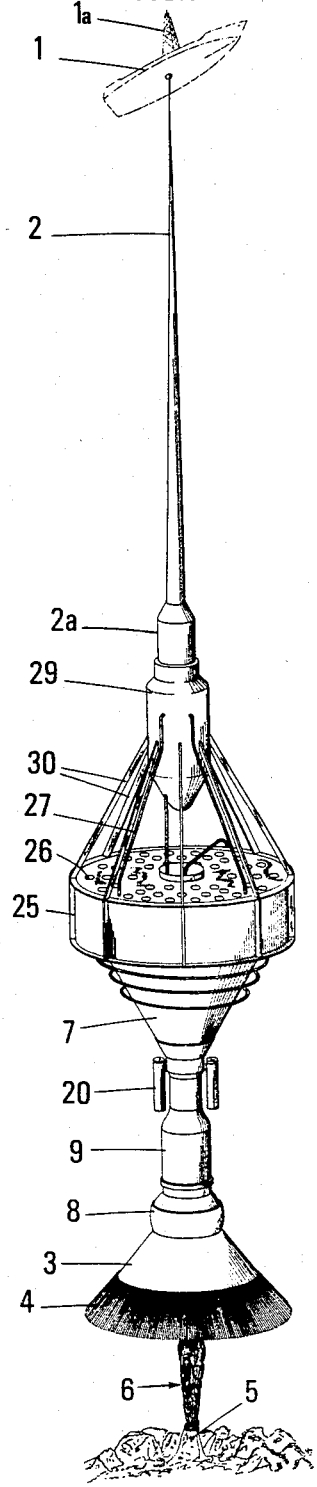
FIG. 1 shows an overall view of a device according to the invention during its setting in place over an underwater hydrothermal source.
Figure 2:
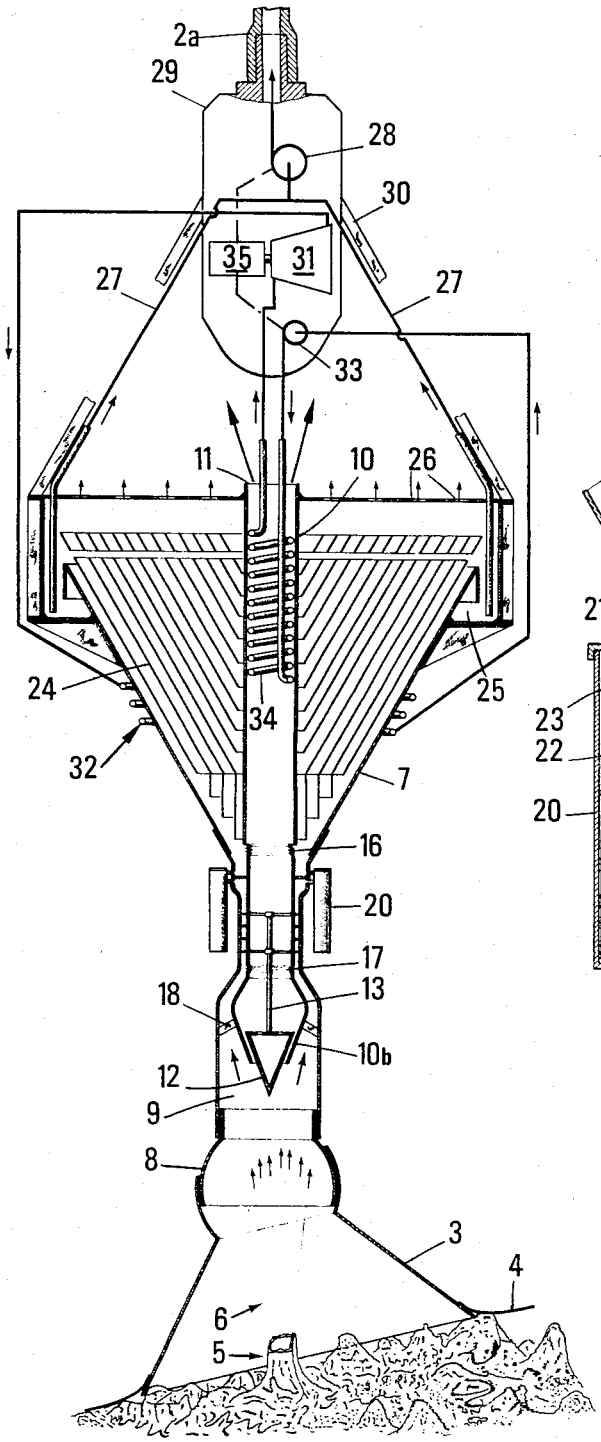
FIG. 2 is a diagrammatic cross-sectional view of the lower part of said device, placed over the mouth of the hydrothermal source.

At its lower part, the device comprises a bell-shaped collector member 3, provided with a flexible skirt 4, made for example of rubber, enabling said collector member to cover substantially tightly the hydrothermal source 5. Reference 6 designates the jet of hydrothermal fluid escaping from said source. FIG. 1 shows the lowering of the collector member 3 and FIG. 2 illustrates the working position.

The collector member 3 is overtopped by a unit 7 for the enrichment with or the concentration of polymetal compounds, having a frusto-conical shape flared upwardly, to which it is connected through a knuckle joint 8.

By this arrangement it is possible to correctly position the base plate of the device on sea bottoms with a certain slope.

The flexible skirt 4 may be deformed by pressure effect and provides for a good sealing of the base plate.

Between the knuckle joint 8 and the enrichment unit 7, is placed an assembly 9 for regulating the flow of hydrothermal fluid feeding the enrichment unit 7.

The regulation means comprises an axial duct 10 opening at 11 in the surrounding water above unit 7 and comprising at its lower part a regulating pinvalve.

The pointed pin 12 is secured to the lower end of a rod 13 and an assembly of annular plates 14 arranged in the annular space 15 surrounding the lower part of duct 10 is adapted to impart to the pin 12 an upward force whose intensity increases with the flow rate of hydrothermal fluid.

Figure 3:
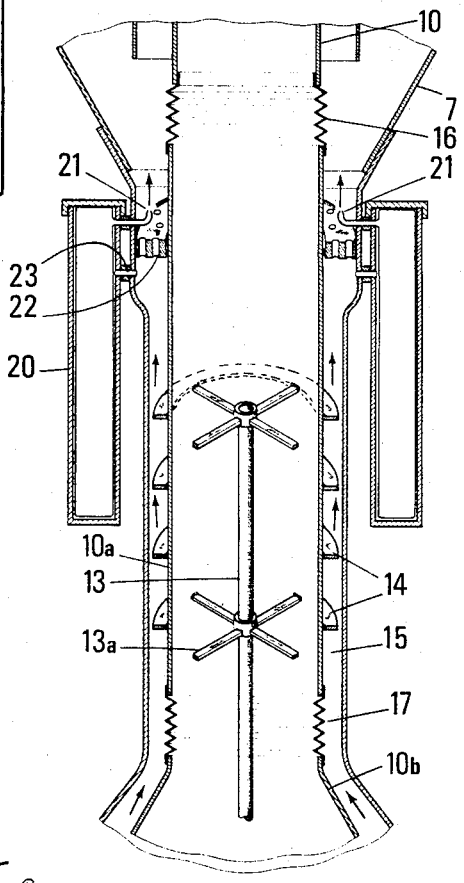
FIG. 3 is a detailed view of the device of FIG. 2.

In these conditions, a progressive lift of the pin occurs, leaving the fluid excess to escape through orifice 11, only a substantially constant flow being fed to unit 7 through the annular space (flow indicated by arrows F in FIGS. 2 and 3).

In the embodiment illustrated in FIG. 3, the rod 13 is secured by radial arms 13*a* to annular plates 14 and two bellows 16 and 17 placed at both ends of the portion 10*a* of the axial duct 10, provide for a limited vertical displacement of the assembly formed by the pin and said duct portion with respect to the valve seat 10*b* which is made integral with the base plate of the device through crossbraces 18.

Figure 4:
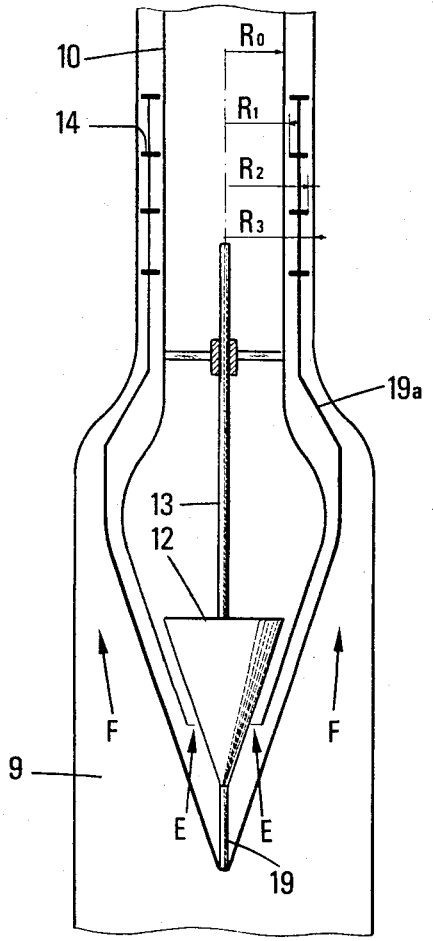
FIG. 4 illustrates an alternative embodiment of the means for regulating the flow of hydrothermal fluid, and FIGS. 5 and 6 diagrammatically illustrate the means for separating the polymetal compounds by centrifugation.

In the alternative embodiment diagrammatically illustrated in FIG. 4, the rod 13 is slidably mounted in the lower portion of the axial duct 10 and the pin 12 is connected through a rod 19 to a crossbrace 19*a* surrounding the lower part 10*a* of the axial duct 10. The annular plates 14 are here secured to the crossbracing system 19*a*, the internal and external radii, respectively $R_1$ and $R_2$, of these plates being selected so that $R_0<R_1<R_2<R_3$, wherein $R_0$ designates the internal radius of the portion 10*a* of the axial duct 10 and $R_3$ the external radius of the duct defining with said portion 10*a* the annular space wherethrough the hydrothermal fluid F feeding the enrichment unit 7 flows at a substantially constant rate.

The fluid excess flows in the direction of the arrows E around the pin 12, lifted by the ascending thrust acting on the annular plates 14.

By this arrangement, the hydrothermal fluid may be collected immediately at the level of the mouth 5 while avoiding any interaction with sea water, so as to maintain the initial concentration of metal sulfides.

In order to favour the precipitation of the metal compounds collected in the enrichment or concentration unit 7, one or more precipitation agents, acting on the pH of the fluid rising up through the annular space surrounding the lower part 10*a* of duct 10, will be advantageously added thereto.

For example, one or more tanks containing an aqueous solution of sodium hydroxide 20 can be used. The flow rate of this product through ducts 21 will be automatically controlled by generating a pressure difference in the hydrothermal fluid flow by means of a grid inducing a pressure drop. The injection is obtained by connecting through ducts 23 the tanks 20 upstream of grid 22 where the prevailing pressure is higher than the downstream pressure.

During the setting in place of the device, the ducts 23 may be advantageously obturated by a rubber membrane which will be destroyed in operation by contact with the hot fluid.

In the example of the embodiment illustrated in FIG. 2, the enrichment or concentration unit 7, comprises an assembly of coaxial frusto-conical settling plates 24, flared upwardly and spaced from one another.

The upper flared part of said plates assembly open in a collecting tank 25 provided at its upper part with one or more exhaust or overflow orifices 26 communicating with the surrounding water.

The hydrothermal fluid slowly flows upwardly at a substantially constant rate through the annular spaces separating the settling plates 24, where a quickened floculation takes place. A fluid enriched with metal polysulfides is discharged from the upper rim of plates 24 into the collecting tank 25 wherefrom it is sucked, through one or more ducts 27, by a power-driven pump unit 28.

This pump unit 28 is housed in a caisson 29 located above the concentration unit 7 and connected thereto through crossbraces 30 (FIG. 1).

The pump unit 28 is energized by a power producing system also housed in caisson 29 and which will be described below.

The fluid of increased metal polysulfides content, sucked by the pump unit 28, is discharged through a metal tubular column 2*a* surmounting the caisson 29, said column being itself connected to the flexible pipe 2.

The use of a metal tubular column 2*a* at the outlet of caisson 29 is justified by the still high temperature of the hydrothermal fluid prevailing at this level, which is liable to damage the core of plastic material of the reinforced flexible pipe 2.

The tight caisson 29 contains a submerged power generator comprising at least one turbine 31. This turbine is actuated by an auxiliary fluid (such as water) flowing in a closed circuit by taking thermal energy from the fluid escaping from the hydrothermal source 5 (the hydrothemral fluid cannot be used directly to drive the turbine 31 in view of its too high corrosive effect).

The water, of which the auxiliary fluid consists, is subjected to a Hirn cycle.

The outlet of the turbine is connected to a first helical heat exchange pipe 32 wound around the enrichment unit 7 and forming a condenser.

The condensed water is taken up by a pump unit 33 which feeds a second helical heat exchange pipe 34. This latter heat exchange pipe is housed in the axial duct 10 passing through unit 7, being thus in contact with water at high temperature and used to produce a steam feeding the turbine 31.

This turbine drives an electric power generator which supplies power to the two pumps units 28 and 33.

It would not be outside the scope of the invention to replace generator 35 by a hydraulic power unit feeding hydraulically driven pumps 28 and 33.

It would be possible to increase the content or the concentration of metal polysulfides in unit 7 by other means than settling.

For example, it would be possible to effect this concentration by centrifugation.

Figure 5:
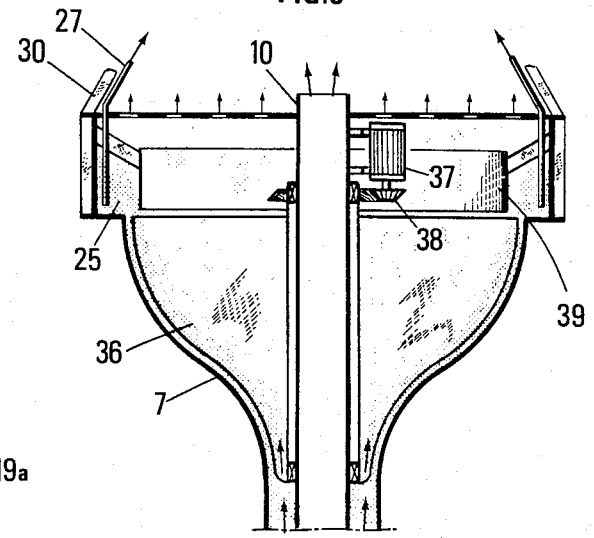
Figure 6:
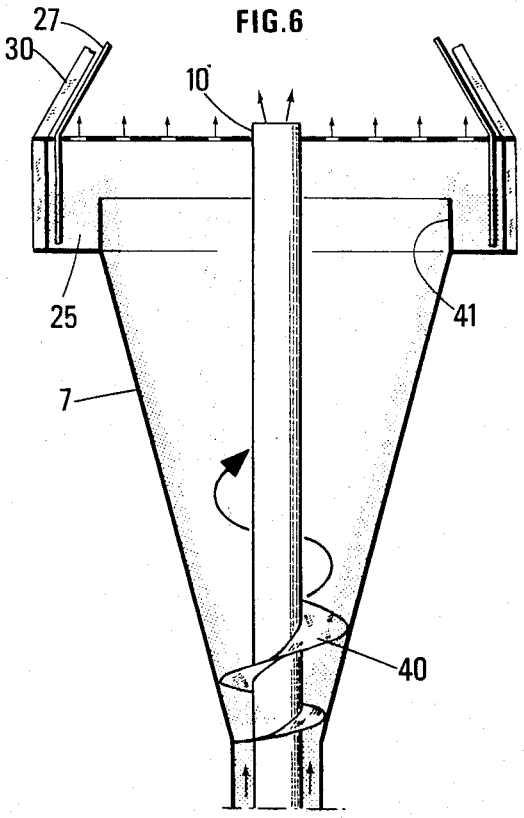

FIGS. 5 and 6 diagrammatically show two types of centrifugation units for concentrating the metal polysulfides, which can be substituted for the settler illustrated in FIG. 2.

In the embodiment of FIG. 5, a centrifugal force is imparted to the metal particles by rotation of the liquid mass flowing into the enrichment unit 7.

The rotation of said liquid mass about the axial duct 10 is induced by vanes 36 having an external profile adapted to that of the wall of the unit 7 and a slightly helical shape, so as to overcome the friction forces of the fluid onto the vanes.

These vanes 36 are driven by an assembly formed of hydraulic or electric motor 37 and pinions 38. The rotation of the liquid mass results in a concentration of the particles at the periphery of the stream, then in the tank 25 wherefrom they are taken up by suction ducts 27.

An annular plate 39, integral with tank 25, enables limiting the suction to the portion of enriched liquid accumulated at the periphery of the enrichment unit 7.

In the embodiment of FIG. 6, the centrifugator forming the enrichment unit 7 is a passive member of the cyclone type.

The rotation speed is imparted to the fluid by a helical ramp 40 surrounding the axial duct 10, which transforms the ascending vertical speed of the fluid into a rotational speed exerted tangentially to the wall of the enrichment unit 7.

This swirling motion has the effect of concentrating the particles externally to the swirl, along the wall of the enrichment unit 7. The enriched flow is discharged over the rim 41 of unit 7 down to the bottom of tank 25, wherefrom said enriched fluid is taken up by the suction ducts 27.

It will be of course possible to bring a certain number of changes to the above-described exemplified embodiments, without departing from the scope of the present invention.

For example, the precipitation of the polymetal compounds at the inlet of the enrichment unit 7 may be achieved or favoured by an abrupt and substantial chilling of the fluid, by means of a cooler which may consist, for example, of a second helical pipe 34 extending down to the inlet level of the enrichment unit 7.

What is claimed is:

1. A process for recovering polymetal compounds comprising metal sulfides discharged from a submarine hydrothermal source, comprising withdrawing hydrothermal fluid in the immediate vicinity of the mouth of said hydrothermal source, thereby avoiding substantial interaction with surrounding sea water to maintain the initial concentration of polymetal compounds, concentrating polymetal compounds, at a location underwater in the so-withdrawn fluid, and raising to the surface of the water a fluid enriched with polymetal compounds.

2. A process according to claim 1, further comprising withdrawing the hydrothermal fluid issuing from the source at a substantially constant flow rate.

3. A process according to claim 1, further comprising adding agents, for precipitating said polymetal compounds, to the withdrawn fluid to enhance polymetal compound enrichment.

4. A process according to claim 3, wherein power is generated in the vicinity of the hydrothermal source by actuating at least one turbine by means of an auxiliary fluid which is caused to flow in a closed circuit, while taking thermal energy from the hydrothermal fluid, and then using at least a part of the power developed by said turbine to raise up to the surface of the water the fluid enriched with polymetal compounds.

5. A process according to claim 1, wherein power is generated in the vicinity of the hydrothermal source by actuating at least one turbine by means of an auxiliary fluid which is caused to flow in a closed circuit, while taking thermal energy from the hydrothermal fluid, and then using at least a part of the power developed by said turbine to raise up to the surface of the water the fluid enriched with polymetal compounds.

6. A process according to claim 1, wherein the flow of withdrawn fluid is regulated to fall within predetermined values by valve means.

7. A process according to claim 1 wherein the polymetal compounds being concentrated and raised to the surface are metal sulfides.

8. A process according to claim 1 wherein the withdrawing step is only conducted during activity periods of the hydrothermal fluid source.

9. A process according to claim 1 wherein the polymetal compounds being raised to the surface are metal polysulfides.

10. A process according to claim 1, comprising the step of chilling the withdrawn fluid to enhance polymetal compound enrichment.

* * * * *